US010020569B2

(12) United States Patent
Huang et al.

(10) Patent No.: US 10,020,569 B2
(45) Date of Patent: Jul. 10, 2018

(54) LAMINATED ANTENNA STRUCTURE

(71) Applicant: Industrial Technology Research Institute, Hsinchu (TW)

(72) Inventors: Meng-Chi Huang, Taoyuan (TW); Tune-Hune Kao, Hsinchu (TW); Wei-Yu Li, Yilan County (TW); Wei Chung, Hsinchu County (TW); Wen-Hua Zhang, Hsinchu County (TW)

(73) Assignee: Industrial Technology Research Institute, Hsinchu (TW)

( * ) Notice: Subject to any disclaimer, the term of this patent is extended or adjusted under 35 U.S.C. 154(b) by 444 days.

(21) Appl. No.: 14/983,553

(22) Filed: Dec. 30, 2015

(65) Prior Publication Data

US 2017/0162936 A1 Jun. 8, 2017

(30) Foreign Application Priority Data

Dec. 4, 2015 (TW) ..... 104140736 A

(51) Int. Cl.

| | |
|---|---|
| ***H01Q 1/38*** | (2006.01) |
| ***H01Q 1/24*** | (2006.01) |
| ***H01Q 1/36*** | (2006.01) |

(52) U.S. Cl.

CPC ..... *H01Q 1/38* (2013.01); *H01Q 1/243* (2013.01); *H01Q 1/364* (2013.01)

(58) Field of Classification Search

CPC ..... H01Q 1/243; H01Q 1/38; H01Q 1/364
USPC ..... 343/700 MS, 873
See application file for complete search history.

(56) References Cited

U.S. PATENT DOCUMENTS

| | | | |
|---|---|---|---|
| 8,581,799 | B2 | 11/2013 | Choi et al. |
| 8,604,998 | B2 | 12/2013 | Choi et al. |

(Continued)

FOREIGN PATENT DOCUMENTS

| | | |
|---|---|---|
| CN | 1534698 | 10/2004 |
| TW | 192509 | 10/1992 |
| TW | 201026182 | 7/2010 |
| TW | 201332405 | 8/2013 |
| TW | 201519724 | 5/2015 |

OTHER PUBLICATIONS

"Notice of Allowance of Taiwan Counterpart Application", dated Mar. 23, 2017, p. 1-p. 5.

(Continued)

*Primary Examiner* — Dameon E Levi
*Assistant Examiner* — Hasan Islam
(74) *Attorney, Agent, or Firm* — JCIPRNET

(57) ABSTRACT

A laminated antenna structure includes a substrate, a first conductive circuit layer, an insulating colloidal layer, a second conductive circuit layer and a conductive structure. The first conductive circuit layer is disposed on or above the substrate, the second conductive circuit layer is disposed above the first conductive circuit layer, and the insulating colloidal layer is disposed between the first and the second conductive circuit layers. The first conductive circuit layer, the insulating colloidal layer and the second conductive circuit layer form a laminated capacitive structure. The conductive structure is electrically connected to a signal source on the substrate, and the signal source is electrically connected to at least one of the first conductive circuit layer and the second conductive circuit layer. The insulating colloidal layer contains catalyzers.

28 Claims, 8 Drawing Sheets

(56) References Cited

U.S. PATENT DOCUMENTS

| | | | | |
|---|---|---|---|---|
| 8,648,763 | B2 | 2/2014 | Choi et al. | |
| 2007/0216408 | A1 | 9/2007 | Ando et al. | |
| 2009/0058731 | A1* | 3/2009 | Geary | H01Q 9/0414 343/700 MS |
| 2010/0009094 | A1 | 1/2010 | Lochtman et al. | |
| 2011/0032154 | A1* | 2/2011 | Chung | H01Q 9/0414 343/700 MS |
| 2011/0175783 | A1 | 7/2011 | Kim | |
| 2014/0159285 | A1 | 6/2014 | Choi | |
| 2015/0364823 | A1* | 12/2015 | Hashimoto | H01Q 1/38 343/700 MS |

OTHER PUBLICATIONS

Meng-Chi Huang et al., "Insulating Colloidal Material and Multilayer Circuit Structure", Unpublished Taiwan application No. 104135497, Filed on Dec. 17, 2015, pp. 1-25.

Yu-Ming Wang et al., "Imanufacturing Method for Multilayer Wiring and Multilayer Wiring Structure", Unpublished Taiwan application No. 104135354 Filed on Oct. 28, 2015, pp. 1-31.

Wei-Yu Li et al., "Beam Antenna", Unpublished Taiwan application No. 104136638 Filed on Nov. 6, 2015, pp. 1-61.

Edwin C. Culbertson, "A new laminate material for high performance PCBs: liquid crystal polymer copper clad films," 45th Electronic Components and Technology Conference, May 21-24, 1995, pp. 520-523.

Jillek et al., "Embedded components in printed circuit boards: A processing technology review," International Journal of Advanced Manufacturing Technology, Feb. 2005, pp. 350-360.

Lefebvre et al., "Copper Electroplating Technology for Microvia Filling," Proceedings of Electronics Circuit World Convention, Oct. 7-9, 2002, pp. 9-14.

Leneke et al., "A multilayer process for fine-pitch assemblies on molded interconnect devices (MIDs) ," 2nd Electronics System-Integration Technology Conference, Sep. 1-4, 2008, pp. 663-668.

Heininger et al., "3D LDS Components for New Production Opportunities," Microwave Journal, Feb. 14, 2012, pp. 1-4.

* cited by examiner

LAMINATED ANTENNA STRUCTURE

CROSS-REFERENCE TO RELATED APPLICATION

This application claims the priority benefit of Taiwan application no. 104140736, filed on Dec. 4, 2015. The entirety of the above-mentioned patent application is hereby incorporated by reference herein and made a part of this specification.

TECHNICAL FIELD

The disclosure relates to a laminated antenna structure.

BACKGROUND

Recently, handheld communication devices have been integrated with 2G/3G/4G Wireless Wide Area Network (WWAN), 4G Long Term Evolution Multi-Input Multi-Output (LTE MIMO), Global Positioning (GPS), Wireless Local Area Network (WLAN), Bluetooth/Wireless Personal Network (BT/WLPN), Near Field Communication (NFC), etc. Moreover, MIMO (multi-input multi-output) multi-antenna being integrated is a very important application for the future handheld communication device in order to increase the transmission speed of data. The MIMO multi-antenna is able to increase data transmission speed and amount of data of wireless communication effectively.

However, in the current handheld communication devices, the surroundings of the board and the plastic case are configured with antenna designs which has a variety of wireless communication applications. Therefore is is difficult to have sufficient antenna layout area to integrate applications of 4G/B4G LTE MIMO multi-frequency multi-antenna system, and applications of the next 5G communication system.

SUMMARY

The disclosure provides one of the present embodiments comprises a laminated antenna structure, and the laminated antenna structure includes a substrate, a first conductive circuit layer, an insulating colloidal layer, a second conductive circuit layer and a conductive structure. The first conductive circuit layer is disposed on or over the substrate, the second conductive circuit layer is disposed over the first conductive circuit layer, and the insulating colloidal layer is disposed between the first and the second conductive circuit layers. The first conductive circuit layer, the insulating colloidal layer and the second conductive circuit layer form a laminated capacitive structure. The conductive structure is electrically connected to a signal source on the substrate, and the signal source is electrically connected to at least one of the first conductive circuit layer and the second conductive circuit layer. The material of the insulating colloidal layer includes a resin, an organic solvent, and catalyzers. The catalyzers are selected from the group consisting of organometallic particles and ionic compounds, wherein the catalyzers account for 0.1-10 wt % of the insulating colloidal layer. The organometallic particles comprise R-M-R' or R-M-X, wherein R and R' are each independently an alkyl group, aromatic hydrocarbon, cycloalkyl, haloalkane, a heterocyclic ring, or carboxylic acid. The carbon number of at least one of R and R' is 3 or more. M is one selected from the group consisting of silver, palladium, copper, gold, tin, and iron, or a combination thereof. X is a halogen compound or an amine. The ionic compounds include $CuCl_2$, $Cu(NO_3)_2$, $CuSO_4$, $Cu(OAc)_2$, AgCl, $AgNO_3$, $Ag_2SO_4$, Ag(OAc), Pd(OAc), $PdCl_2$, $Pd(NO_3)_2$, $PdSO_4$, $Pd(OAc)_2$, $FeCl_2$, $Fe(NO_3)_2$, $FeSO_4$, or $[Fe_3O(OAc)_6(H_2O)_3]OAc$.

Another of the present embodiments comprises a laminated antenna structure including a substrate, a first conductive circuit layer, an insulating colloidal layer, a second conductive circuit layer, a conductive via, and a conductive structure. The first conductive circuit layer is disposed on or over the substrate, and the second conductive circuit layer is disposed over the first conductive circuit layer. The insulating colloidal layer is located between the first conductive circuit layer and the second conductive circuit layer. The conductive via is located in the insulating colloidal layer, and the conductive via connects the first conductive circuit layer and the second conductive circuit layer, so as to form a laminated inductive structure. The conductive structure is electrically connected to a signal source on the substrate, and the signal source is electrically connected to one of the first conductive circuit layer and the second conductive circuit layer. The material of the insulating colloidal layer includes a resin, an organic solvent, and catalyzers. The catalyzers are selected from the group consisting of organometallic particles and ionic compounds, wherein the catalyzers account for 0.1-10 wt % of the insulating colloidal layer. The organometallic particles comprise R-M-R' or R-M-X, wherein R and R' are each independently an alkyl group, aromatic hydrocarbon, cycloalkyl, haloalkane, a heterocyclic ring, or carboxylic acid, and the carbon number of at least one of R and R' is 3 or more. M is one selected from the group consisting of silver, palladium, copper, gold, tin, and iron, or a combination thereof. X is a halogen compound or an amine. The ionic compounds include $CuCl_2$, $Cu(NO_3)_2$, $CuSO_4$, $Cu(OAc)_2$, AgCl, $AgNO_3$, $Ag_2SO_4$, Ag(OAc), Pd(OAc), $PdCl_2$, $Pd(NO_3)_2$, $PdSO_4$, $Pd(OAc)_2$, $FeCl_2$, $Fe(NO_3)_2$, $FeSO_4$, or $[Fe_3O(OAc)_6(H_2O)_3]OAc$.

Several exemplary embodiments accompanied with figures are described in detail below to further describe the disclosure in details.

BRIEF DESCRIPTION OF THE DRAWINGS

The accompanying drawings are included to provide further understanding, and are incorporated in and constitute a part of this specification. The drawings illustrate exemplary embodiments and, together with the description, serve to explain the principles of the disclosure.

DETAILED DESCRIPTION OF DISCLOSED EMBODIMENTS

Figure 1:
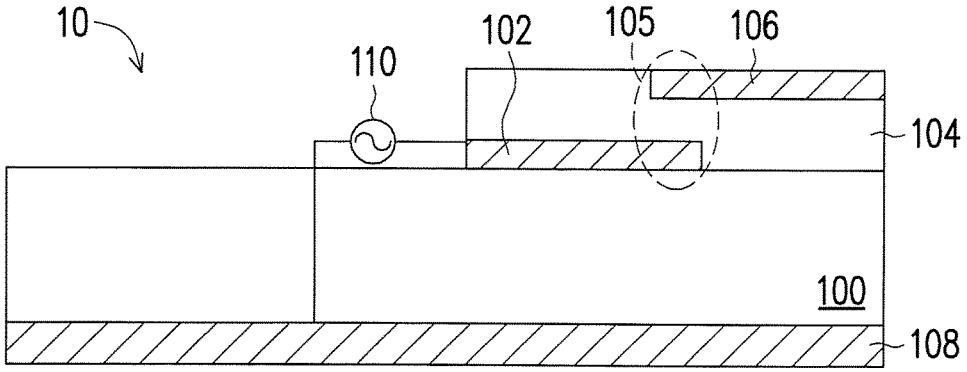
FIG. 1 is a schematic cross-sectional view of a laminated antenna structure according to an exemplary embodiment of the disclosure.

FIG. 1 is a schematic cross-sectional view of a laminated antenna structure according to an exemplary embodiment of the disclosure.

Referring to FIG. 1, a laminated antenna structure 10 includes a substrate 100, a first conductive circuit layer 102, an insulating colloidal layer 104, a second conductive circuit layer 106 and a conductive structure 108. The first conductive circuit layer 102 is disposed on the substrate 100, wherein the material of the substrate 100 is, for example, glass, sapphire, silicon, silicon germanium, silicon carbide, gallium nitride, or a polymer material. The second conductive circuit layer 106 is disposed over the first conductive circuit layer 102, the insulating colloidal layer 104 is disposed between the first conductive circuit layer 102 and the second conductive circuit layer 106, and the first conductive circuit layer 102, the insulating colloidal layer 104, and the second conductive circuit layer 106 form a laminated capacitive structure 105. The overlapped or adjacent portions of the first conductive circuit layer 102 and the second conductive circuit layer 106 may generate the capacitance effect, and the thickness of the insulating colloidal layer 104 is, for example, thinner than 1900 μm, so that the layout area occupied by the coplanar capacitive structure may be reduced to inhibit the parasitic coupling effect generated by the coplanar capacitive structure and the adjacent antenna's conductive circuit. Therefore, the size of the laminated antenna structure 10 is minimized, and thus the quality factor of the entirety of the antenna may be reduced to effectively increase the impedance bandwidth of the resonant mode, which is excited by the same antenna structure, whereby improving the radiation efficiency. Moreover, by adjusting the thickness of the insulating colloidal layer 104 and the spacing between the overlapped or adjacent portions of the first conductive circuit layer 102 and the second conductive circuit layer 106, the capacitance value of the laminated capacitive structure 105 may be adjusted so as to increase the operating bandwidth of the laminated antenna structure 10.

The conductive structure 108 is connected to a signal source 110 on the substrate 100, and the signal source 110 is connected to (e.g. electrically coupled or electrically connected) at least one of the first conductive circuit layer 102 and the second conductive circuit layer 106. In the present embodiment, the signal source 110 is connected to the first conductive circuit layer 102 as an example for purpose of explanation, but the disclosure is not limited thereto. In other embodiments, the signal source 110 may be connected to the second conductive circuit layer 106 or connected to the first conductive circuit layer 102 and the second conductive circuit layer 106 simultaneously. In addition, although the conductive structure 108 is disposed on the surface opposite to the first and the second conductive circuit layers 102 and 106, and the insulating colloidal layer 104 in FIG. 1, but the disclosure is not limited thereto. According to circuit design, the conductive structure 108 may be disposed on the same surface of the substrate 100 that the first conductive circuit layer 102 is disposed on.

The material of the insulating colloidal layer 104 includes a resin, an organic solvent, and catalyzers. The catalyzers are selected from the group consisting of organometallic particles and ionic compounds.

The organometallic particles include R-M-R' or R-M-X, wherein R and R' are each independently an alkyl group, aromatic hydrocarbon, cycloalkyl, haloalkane, a heterocyclic ring, or carboxylic acid. The carbon number of at least one of R and R' is 3 or more. The more the carbon number, the greater the solubility with the organic solvent, and thus it is easier to dissolve in the polymer colloid (i.e. the resin and the organic solvent). However, if the carbon number is insufficient, the catalyzers may be miscible with a high-polar solvent and not easy to dissolve in the polymer colloid. M is one selected from the group consisting of silver, palladium, copper, gold, tin, and iron, or a combination thereof; X is a halogen compound or an amine.

The ionic compounds include $CuCl_2$, $Cu(NO_3)_2$, $CuSO_4$, $Cu(OAc)_2$, AgCl, $AgNO_3$, $Ag_2SO_4$, Ag(OAc), Pd(OAc), $PdCl_2$, $Pd(NO_3)_2$, $PdSO_4$, $Pd(OAc)_2$, $FeCl_2$, $Fe(NO_3)_2$, $FeSO_4$, or $[Fe_3O(OAc)_6(H_2O)_3]OAc$. The organometallic particles and the ionic compounds may be used alone or in a combination of two or more.

The resin in the present embodiment is, for example, polyphenylene oxide (PPO), bismaleimide triazine (BT), cyclo olefin copolymer (COC), a liquid crystal polymer (LCP), polyimide, or an epoxy resin.

The organic solvent in the present embodiment may be a low-polar organic solvent, in particular an organic solvent miscible with the catalyzers and the resin. The organic solvent is, for example, methanol, acetone, toluene, methyl ethyl ketone, dipropylene glycol methyl ether (DPM), or propylene glycol monomethyl ether acetate. For instance, the solubility of the catalyzers in the organic solvent is greater than 0.1 wt %. Since the catalyzers are completely miscible with the organic solvent and with the resin; therefore, the ratio of the catalyzers to the insulating colloidal material 104 is low and the catalyzers may account for 0.1-10 wt % of the insulating colloidal material 104, and preferably, 0.5-10 wt %. The viscosity coefficient of the material of the insulating colloidal layer 104 is, for example, between 500 cps and 200000 cps, and it may be changed according to the difference of the substrates 100. For instance, if the substrate 100 is a polymer substrate of the 3D mobile phone case or the like, the viscosity coefficient of the material of the insulating colloidal layer 104 is low, approximately, between 500 cps and 3000 cps. If the substrate 100 is a flat circuit board of the mobile phone printed circuit board (PCB) or the like, the viscosity coefficient of the material of the insulating colloidal layer 104 is high, approximately, larger than 10000 cps.

The material of the insulating colloidal layer 104 may include other constituents, such as an absorbent and a colorant. The absorbent is, for instance, methylbenzene dithiol or pyridine containing Co, Ni, or Fe for increasing the reaction of the resin in the material of the insulating colloidal layer 104 and a laser light, whereby reducing the laser wattage needed for the vaporization of the material of the insulating colloidal layer 104. The colorant, for example, is a general dye, such as an inorganic colorant or an organic colorant. The inorganic colorant is, for instance, carbon black or titanium dioxide, and the organic colorant is, for instance, an azo pigment (—N═N—), copper phthalocyanine blue ($C_{32}H_{16}N_8Cu$), or phthalocyanine green ($C_{32}HCl_{15}N_8Cu$). The additive amount of the absorbent is, for instance, 0.1 wt % to 10 wt % of the total amount of the material of the insulating colloidal layer 104, and the additive amount of the colorant is, for instance, 1 wt % to 45 wt % of the total amount of the material of the insulating colloidal layer 104. The additive amount of the colorant is related to the dielectric constant of the insulating colloidal layer 104, and therefore, is changed according to the requirement of the antenna design.

The insulating colloidal layer 104 may also include a fiber structure or ceramic particles. The fiber structure is, for example, glass fiber or carbon fiber for improving the mechanical strength of the insulating colloidal layer 104. The above-mentioned fiber structure or additive amount of the ceramic particles is related to the dielectric constant of the insulating colloidal layer 104, and therefore, is changed according to the requirement of the antenna design. The ceramic particles are, for example, particles of silicon dioxide, aluminium oxide, or aluminum nitride, by increasing the content of the ceramic particles in the insulating colloidal layer 104, the dielectric constant of the insulating colloidal layer 104 is increased, and then, the capacitance value of the laminated antenna structure 10 is increased. In addition, the content of the ceramic particles in the insulating colloidal layer 104 may be adjusted to reduce the thermal expansion coefficient between different materials and to increase the shear modulus of the insulating colloidal layer 104.

As described above, the laminated antenna structure 10 of the present embodiment may inhibit the parasitic coupling effect, and then, to reduce the quality factor of the entirety of the antenna. Accordingly, the impedance bandwidth may be increased to improve the radiation efficiency. Otherwise, the capacitance value of the laminated antenna structure 10 may be determined by three factors including the thickness of the insulating colloidal layer 104, the spacing between the overlapped or adjacent portions of the first conductive circuit layer 102 and the second conductive circuit layer 106, and the dielectric constant of the material of the insulating colloidal layer 104. By adjusting the above-mentioned factors, the feed-in capacitance applied to the laminated antenna structure 10 may be varied to achieve the impedance matching, lower the modal resonance frequency of the antenna unit and increase the operating bandwidth.

Figure 2:
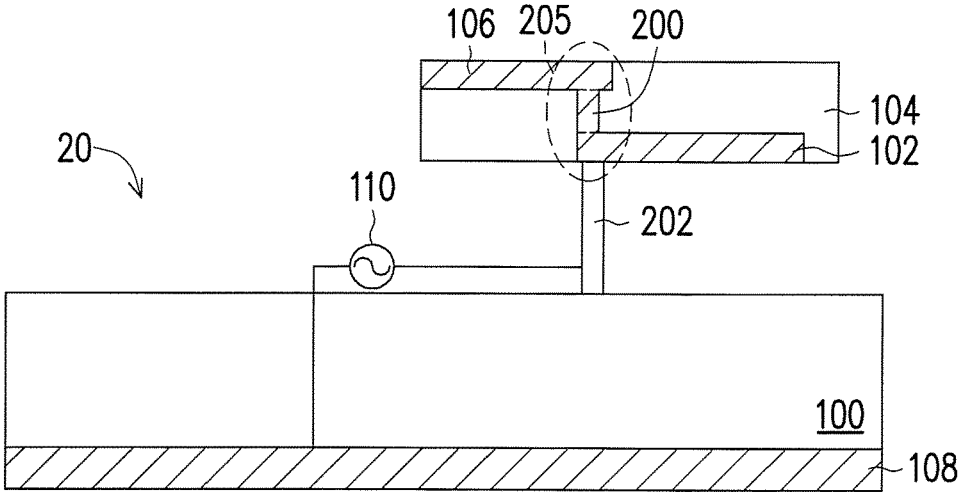
FIG. 2 is a schematic cross-sectional view of a laminated antenna structure according to another exemplary embodiment of the disclosure.

FIG. 2 is a schematic cross-sectional view of a laminated antenna structure according to another exemplary embodiment of the disclosure, wherein the same symbols of elements as in FIG. 1 are used to represent the same or similar members.

Referring to FIG. 2, a laminated antenna structure 20 of the present embodiment includes the substrate 100, the first conductive circuit layer 102 formed over the substrate 200, the insulating colloidal layer 104, the second conductive circuit layer 106 and the conductive structure 108 of the preceding embodiment, and further includes a conductive via 200. The conductive via 200 is located in the insulating colloidal layer 104 and connected the first conductive circuit layer 102 and the second conductive circuit layer 106, so as to form a laminated inductive structure 205. In addition, the transmission structure 202 is utilized to connect the signal source 110 and the first conductive circuit layer 102.

The laminated inductive structure 205 is formed by the conductive via 200 and the two circuit layers (102 and 106), since the conductive via 200 does not occupy on the surface area of the structure, the surface area of the substrate 100 on which the antenna structure occupies is effectively reduced so as to inhibit the parasitic coupling effect generated by the coplanar inductive structure and the adjacent antenna's conductive circuit. Therefore, according to the laminated antenna structure 20, the quality factor of the entirety of the antenna may be reduced to effectively increase the impedance bandwidth of the resonant mode, which is excited by the same antenna structure, whereby improving the radiation efficiency.

Figure 3:
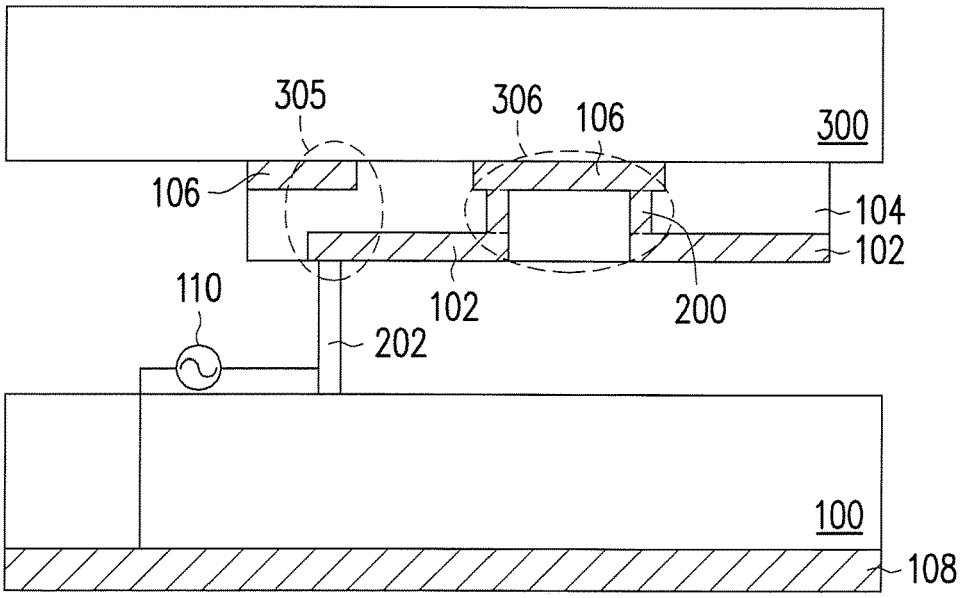
FIG. 3 is a schematic cross-sectional view of a laminated antenna structure according to yet another exemplary embodiment of the disclosure.

FIG. 3 is a schematic cross-sectional view of a laminated antenna structure according to another exemplary embodiment of the disclosure, wherein the same symbols of elements as in FIG. 1 and FIG. 2 are used to represent the same or similar members.

Referring to FIG. 3, the present embodiment is the integration of the antenna structures in FIG. 1 and FIG. 2, and therefore, may include the conductive via 200 that is connected a portion of the first conductive circuit layer 102 and a portion of the second conductive circuit layer 106, so as to form a laminated capacitive structure 305 and a laminated inductive structure 306 simultaneously.

In addition, when the laminated antenna structure of the present embodiment is applied to the mobile phone, the entirety of the laminated antenna structure is integrated onto a polymer baseplate 300 of the mobile phone's 3D case or the like, and the substrate 100 may be the mobile phone PCB.

Furthermore, if there is no conductive via 200 connecting between the first conductive circuit layer 102 and the second conductive circuit layer 106 in FIG. 3, at least one conductive circuit layer may still be designed as a coplanar inductive structure, so as to form the laminated antenna structure having laminated capacitive structure and a coplanar inductive structure, and the shape of the coplanar inductive structure is, for example, rectilinear shape, zigzag shape, S-shape, or spiral shape.

FIGS. 4A to 4D are schematic cross-sectional views depicting a fabricating process of a laminated antenna structure according to an exemplary embodiment of the disclosure.

Figure 4A:
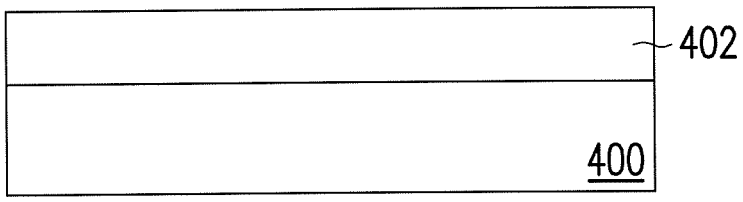
FIGS. 4A to 4E are schematic cross-sectional views depicting a fabricating process of a laminated antenna structure according to an exemplary embodiment of the disclosure.

Referring to FIG. 4A, firstly, an insulating colloidal layer 402 is formed on a polymer substrate 400, and the selection of the material of the insulating colloidal layer 402 may reference to the related description of the embodiment in FIG. 1. The method of forming the insulating colloidal layer 402 is, for example, coating the material of the insulating colloidal layer 402 on the polymer substrate 400, heating to remove the organic solvent, and curing the material. Since the amount of the catalyzers in the material of the insulating colloidal layer 402 is small, so that the dielectric constant and the dielectric loss of the insulating colloidal layer 402 after curing still retain their characteristics.

Figure 4B:
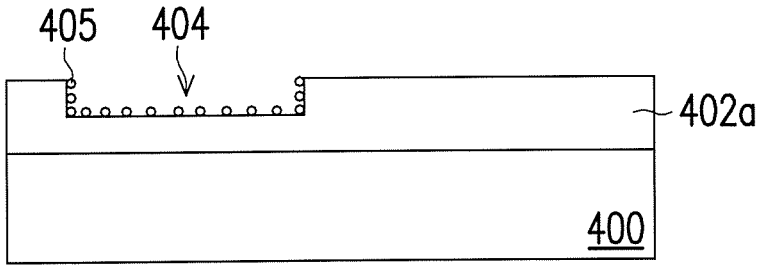

Referring to FIG. 4B, several trenches 404 are formed by laser melting, and activated catalyzers 405 in the insulating colloidal layer 402*a* are deposited on the sidewalls and the bottom of the trench 404. The laser is, for example, YAG laser or argon laser, and the wavelength of the laser is between 200 nm and 1200 nm, but the disclosure is not limited thereto.

Figure 4C:
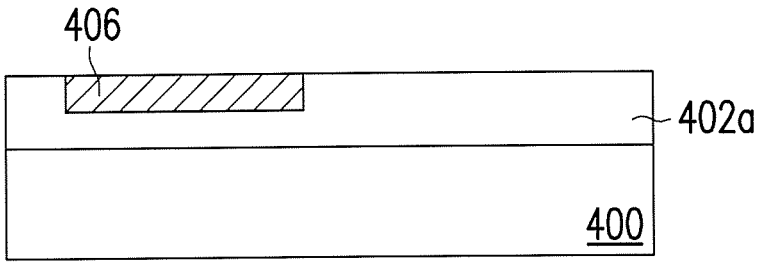

After that, referring to FIG. 4C, a metal wiring deposition is performed by the electroless process for forming a first conductive circuit layer 406, and thus there is no need for other complicated processes such as sputtering. In the present embodiment, the material of the first conductive circuit layer 406 is, for example, copper, nickel, silver, etc. For example, the electroless process is to place the structure shown in FIG. 4B in an electroplating solution. Since the metal ions in the electroplating solution and the activated catalyzers 405 on the sidewalls and the bottom of the trench 404 occur redox reaction, the metal ions may reduce back to metal and then deposit in the trench 404, so as to form the first conductive circuit layer 406.

Figure 4D:
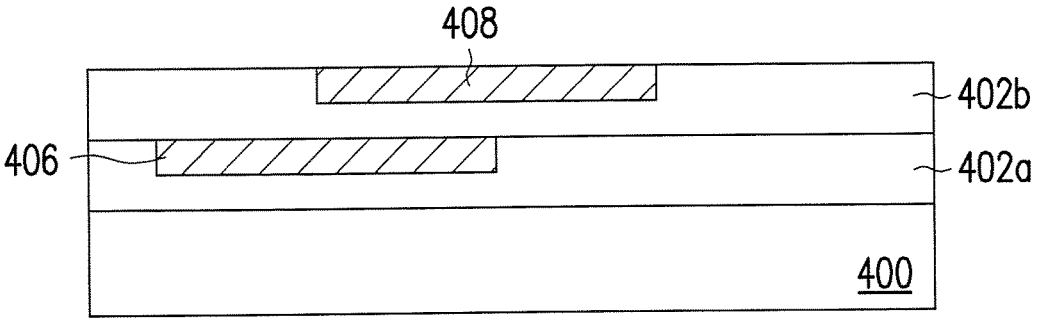

After that, referring to FIG. 4D, the method as depicted in FIGS. 4A-4C is repeated to form another insulating colloidal layer 402*b* and the second conductive circuit layer 408 on the first conductive circuit layer 406. In addition, the materials of the insulating colloidal layer 402*a* and the insulating colloidal layer 402*b* may be the same, and the material of the second conductive circuit layer 408 is, for example, copper, nickel, silver, etc.

Figure 4E:
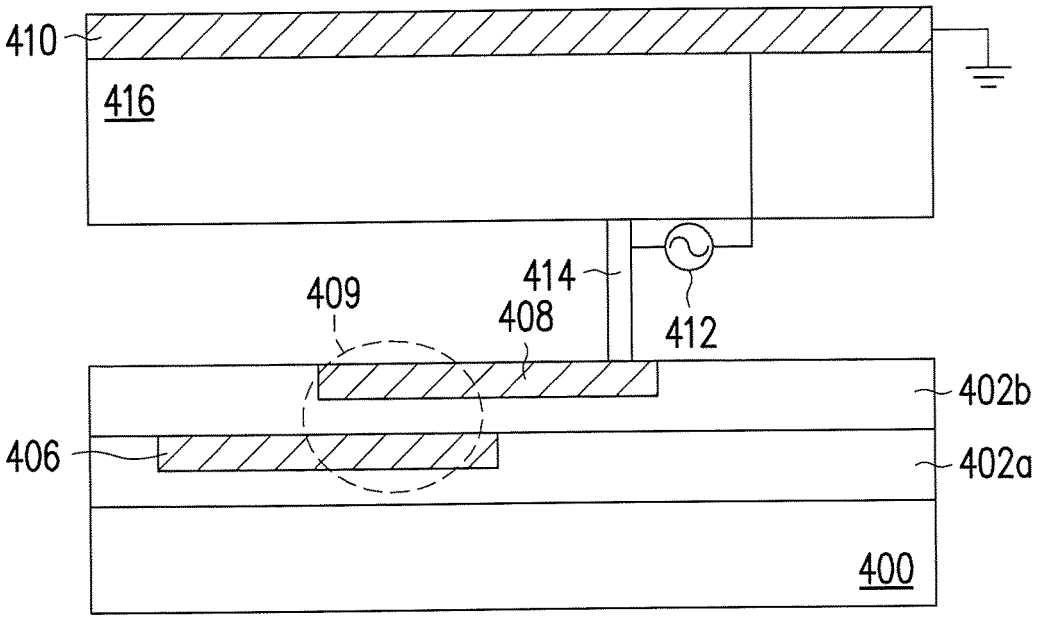

Referring to FIG. 4E subsequently, a conductive layer 410 is electrically connected to a signal source 412 on a substrate 416, and the signal source 412 is electrically connected to (or electrically coupled to) the second conductive circuit layer 408 through a transmission structure 414. In the present embodiment, the signal source 412 is electrically connected to the second conductive circuit layer 408, but the disclosure is not limited thereto. In other embodiments, the signal source 412 may be connected to the first conductive circuit layer 406, or connected to the first conductive circuit layer 406 and the second conductive circuit layer 408 simultaneously. The first conductive circuit layer 406, the insulating colloidal layer 402*b* and the second conductive circuit layer 408 form a laminated capacitive structure 409.

Figure 5A:
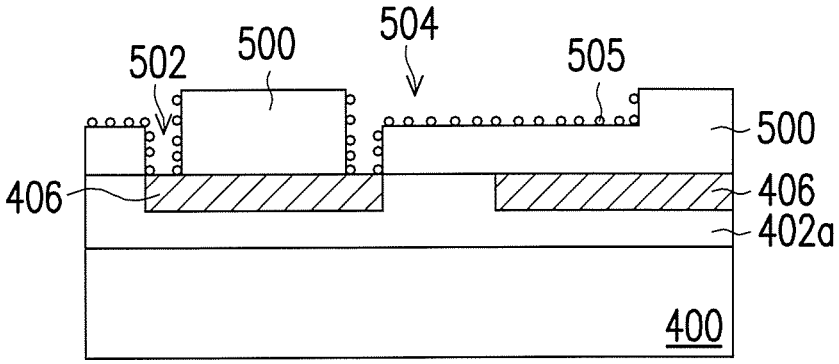
FIGS. 5A to 5B are schematic cross-sectional views depicting a fabricating process of a laminated antenna structure according to another exemplary embodiment of the disclosure.
Figure 5B:
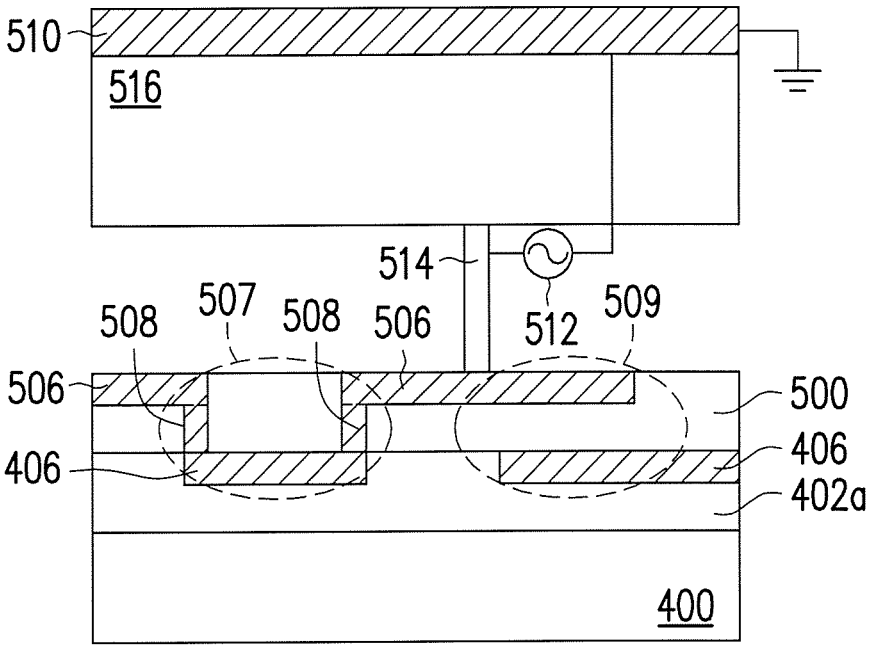

FIGS. 5A to 5B are schematic cross-sectional views depicting a fabricating process of a laminated antenna structure according to another exemplary embodiment of the disclosure, wherein the same symbols of elements as in FIG. 4C are used to represent the same or similar members.

Referring to FIG. 5A, FIG. 5A is a step after FIG. 4C, and the designs of the first conductive circuit layers 406 in FIG. 5A and in FIG. 4C are slightly different from each other. Another insulating colloidal layer 500 may be formed on the first conductive circuit layer 406, and the materials of the insulating colloidal layer 402*a* and the insulating colloidal layer 500 may be the same. Afterwards, the laser is used to melt the insulating colloidal layer 500 so as to form several vias 502 and trenches 504, and the activated catalyzers 505 in the insulating colloidal layer 500 may be deposited on the sidewalls of the vias 502 and the sidewalls and the bottom of the trench 504.

Referring to FIG. 4C subsequently, the metal wiring deposition is performed by the electroless process so as to form the second conductive circuit layer 506 and the conductive via 508, wherein the electroless process may reference to the related description of the embodiment in FIG. 4C. The conductive via 508 in the present embodiment connects a portion of the first conductive circuit layer 406 and a portion of the second conductive circuit layer 506, so as to form the laminated inductive structure 507. The first conductive circuit layer 406 not in contact with the conductive via 508 may form a laminated capacitive structure 509 with the insulating colloidal layer 500 and the second conductive circuit layer 506. After that, a conductive layer 510 is electrically connected to a signal source 512 on the substrate 516, and the signal source 512 is electrically connected to (or electrically coupled to) the second conductive circuit layer 506 through a transmission structure 514.

Figure 6:
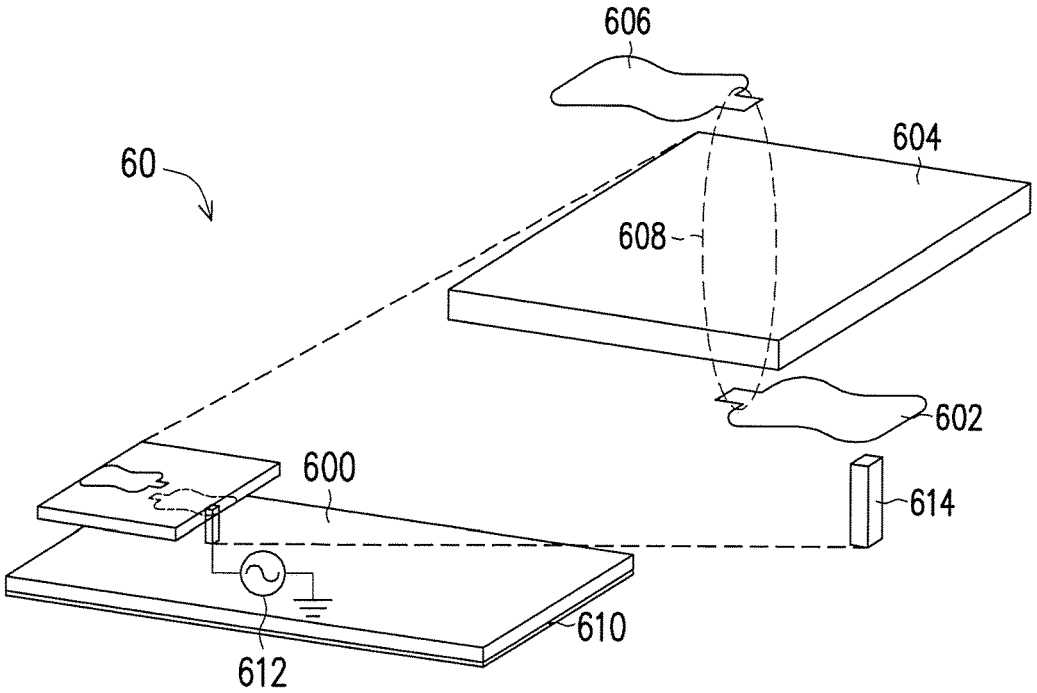
FIG. 6 is a three-dimensional perspective view of a laminated antenna structure according to another exemplary embodiment of the disclosure.
Figure 7:
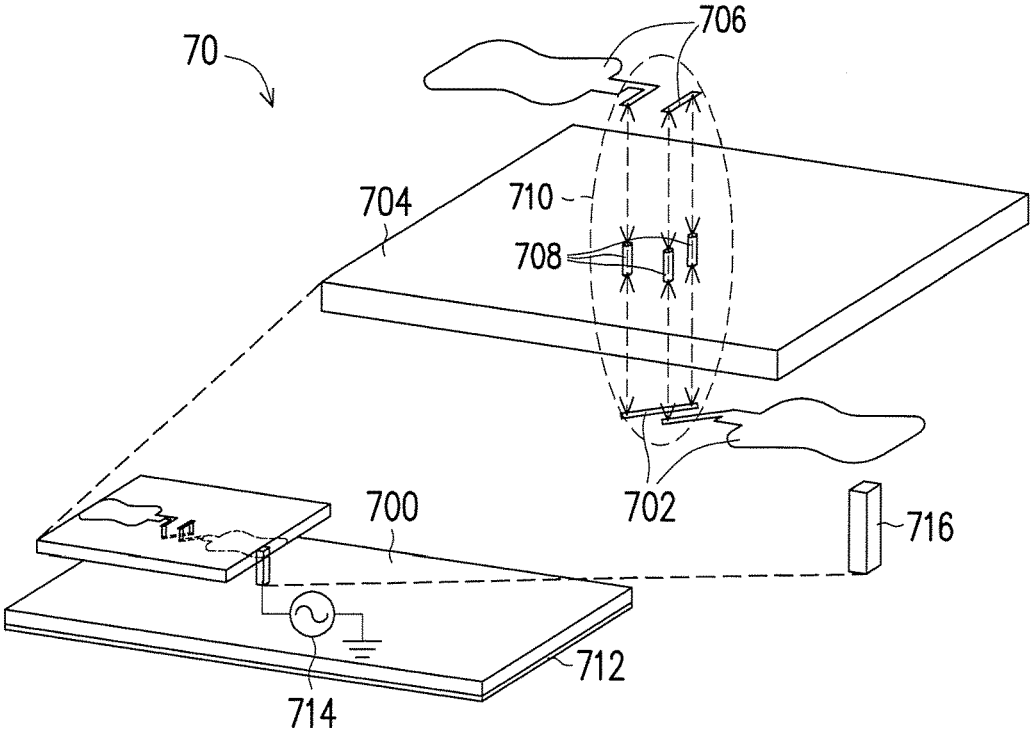
FIG. 7 is a three-dimensional perspective view of a laminated antenna structure according to another exemplary embodiment of the disclosure.
Figure 8:
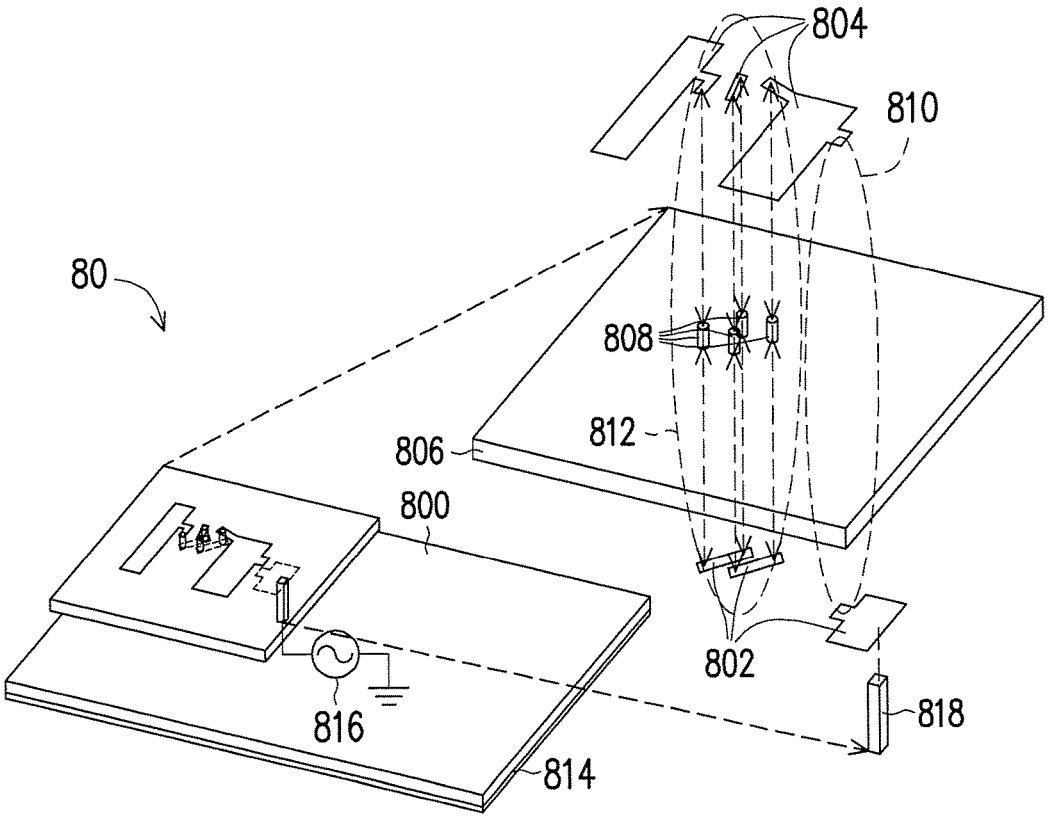
FIG. 8 is a three-dimensional perspective view of a laminated antenna structure according to another exemplary embodiment of the disclosure.

In order to clarify each of the wiring layers of the disclosure, referring to the three-dimensional perspective views according to FIG. 6 to FIG. 8.

A laminated antenna structure 60 in FIG. 6 has a laminated capacitive structure 608 located over a substrate 600, and the laminated capacitive structure 608 is formed by a first and a second conductive circuit layers 602, 606 and an insulating colloidal layer 604. A conductive structure 610 is electrically connected to a signal source 612 on the substrate 600, and the signal source 612 is electrically connected to the first conductive circuit layer 602 through a transmission structure 614. The selection of the material of the insulating colloidal layer 604 may reference to the related description of the embodiment in FIG. 1, the thickness of the insulating colloidal layer 604 is thinner than 1900 μm, for example. The first conductive circuit layer 602 and the second conductive circuit layer 606 may be manufactured to different antenna layouts, and the irregular shapes are described in the present embodiment as an example, but the disclosure is not limited thereto.

A laminated antenna structure 70 in FIG. 7 has an insulating colloidal layer 704 located over a substrate 700 and a laminated inductive structure 710 that is formed by a conductive vias 708, which is located in the insulating colloidal layer 704, connecting a first and a second conductive circuit layers 702 and 706, which are respectively located on two surfaces of the insulating colloidal layer 704. A conductive structure 712 is connected to a signal source 714 on the substrate 700, and the signal source 714 is electrically connected to the first conductive circuit layer 702 through the transmission structure 716. The selection of the material of the insulating colloidal layer 704 may reference to the related description of the embodiment in FIG. 1. The first conductive circuit layer 702 and the second conductive circuit layer 706 may be manufactured to different antenna layouts, and the irregular shapes are described in the present embodiment as an example, but the disclosure is not limited thereto.

A laminated antenna structure 80 in FIG. 8 is the integration of a first conductive circuit layer 802, a second conductive circuit layer 804, an insulating colloidal layer 806, and a conductive vias 808 over a substrate 800, so as to form a laminated capacitive structure 810 and a laminated inductive structure 812. Since the material of the insulating colloidal layer 806 contains the catalyzers as described in FIG. 1, the thickness of the insulating colloidal layer 806 is reduced to be thinner than 1900 μm, and hence, the fine circuit is manufactured successfully. Therefore, the required layout area of the capacitor and the inductor is successfully minimized. Accordingly, the parasitic coupling storage effect of the capacitive and inductive structures is effectively reduced. Simultaneously, the size of the antenna is minimized, the Q value of the entirety of the antenna is reduced, the parasitic storage effect of the antenna is decreased, and the impedance bandwidth of the antenna is increased.

Experimental examples are described below to verify the efficacy of the disclosure. However, the disclosure is not limited to the following content.

Experimental Example

Figure 9A:
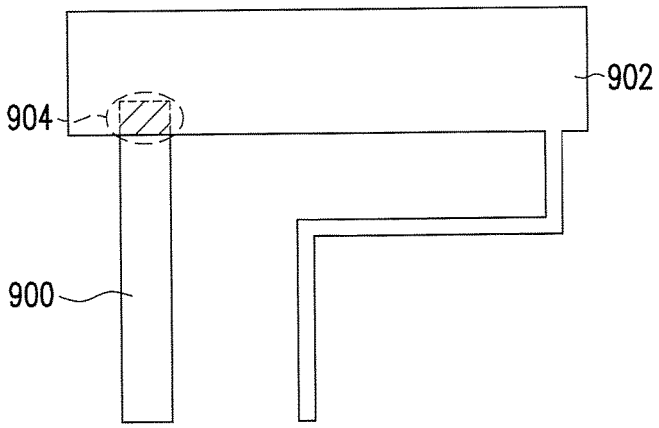
FIG. 9A is a schematic top view of laminated capacitive structure antenna design in an experimental example of the laminated antenna structure.
Figure 9B:
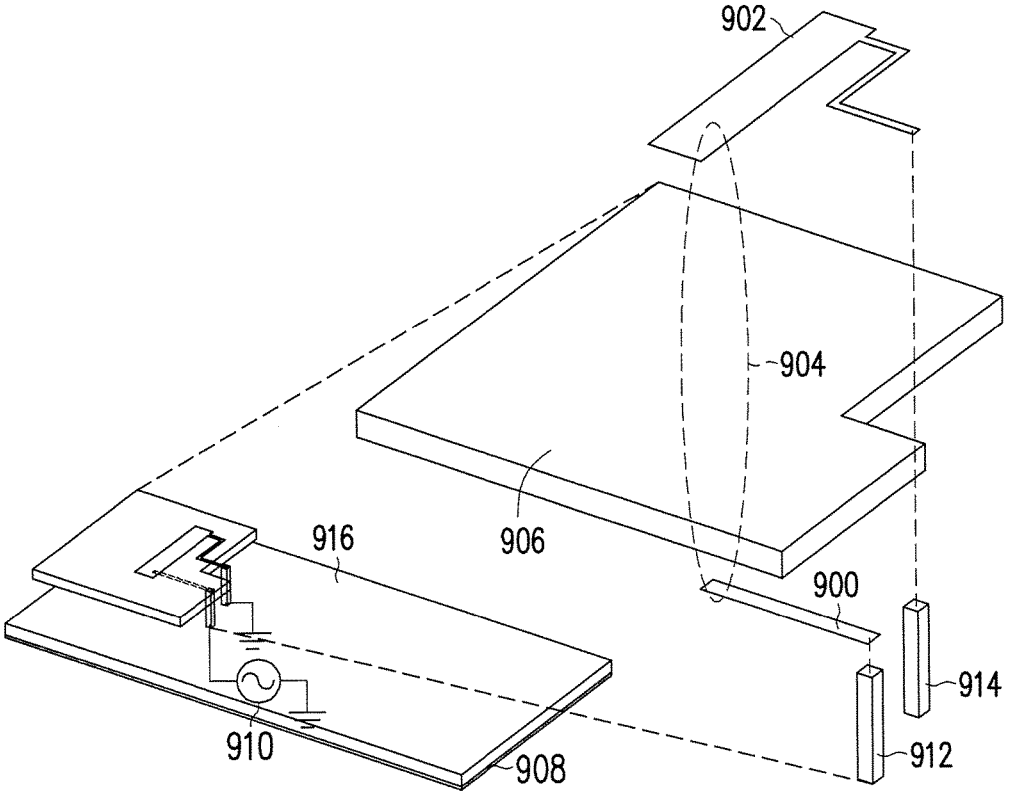
FIG. 9B is a three-dimensional perspective view of the laminated antenna structure of the experimental example.

FIG. 9A is a schematic top view of a laminated capacitive structure antenna design in an experimental example of the laminated antenna structure; FIG. 9B is a three-dimensional perspective view of the laminated antenna structure of the experimental example. The two-layer structure including the first conductive circuit layer 900 and the second conductive circuit layer 902 is shown in FIG. 9A, and an insulating colloidal layer (not shown) is disposed therebetween. The overlapped portions of the two circuit layers 900 and 902 may form the laminated capacitive structure 904, the area thereof (the overlapped portions of 900 and 902) is approximately equal to 2×0.3 $mm^2$. The position of the insulating colloidal layer 906 may be observed in FIG. 9B, and the thickness of the insulating colloidal layer 906 in the experimental example is approximately equal to 500 μm. The conductive structure 908 is electrically connected to the signal source 910, and the signal source 910 is electrically connected to the first conductive circuit layer 900 through the transmission structure 912, another transmission structure 914 is electrically connected to the conductive structure 908. The total antenna layout area of the laminated antenna structure in the experimental example in FIG. 9A is around 33×15 $mm^2$.

Comparative Example

Figure 10:
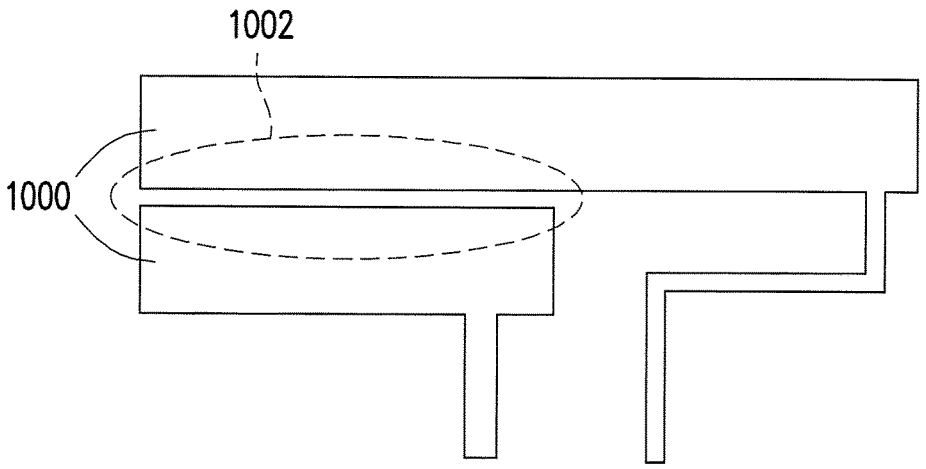
FIG. 10 is schematic view of a coplanar capacitive structure antenna design of a comparative example.

FIG. 10 is schematic view of a coplanar capacitive structure antenna design of a comparative example, wherein the coplanar capacitive structure 1002 formed by the coplanar conductive circuit layers 1000 is shown. The area occupied by the coplanar capacitive structure 1002 is approximately equal to 35×16 $mm^2$, the required layout area of the capacitive structure is significantly greater than the layout area of the laminated capacitive structure 904 formed by the conductive circuit layers 900 and 902 in FIG. 9A. Therefore, the total layout area of the coplanar capacitive structure of the antenna of the comparative example in FIG. 10 is also significantly greater than the total layout area of the laminated antenna structure of the experimental example in FIG. 9A. The total layout area of the coplanar capacitive structure of the antenna of the comparative example in FIG. 10 is approximately equal to 48×16 $mm^2$.

Testing Example

Figure 11:
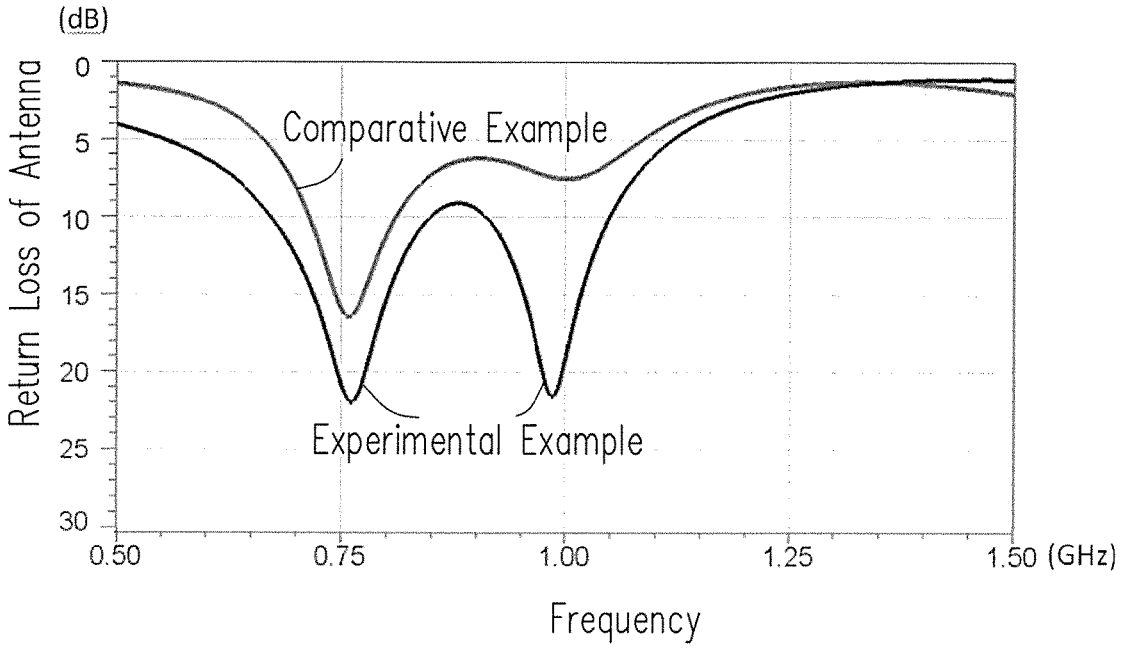
FIG. 11 is a comparison graph of return loss between the experimental example and the comparative example.

The experimental example and the comparative example are tested to obtain a comparison graph in FIG. 11 of return loss curves of the antennas. As shown in FIG. 11, compared to the coplanar capacitive antenna structure of the comparative example, the laminated antenna structure of the experimental example is able to improve impedance matching degree of the resonant mode of the antenna. Therefore, the operating bandwidth of the resonant mode excited by the antenna is increased, so as to achieve more frequency bands of operating system, and to enhance the radiation characteristics of the antenna. Because the required layout area of the capacitive structure is effectively minimized in the laminated antenna structure of the disclosure, the parasitic storage effect of the capacitive structure may be reduced effectively. Simultaneously, the size of the antenna is minimized, the Q value of the entirety of the antenna is reduced, the parasitic storage effect of the antenna is decreased, and the impedance bandwidth of the antenna is increased.

In summary, the conductive layout area occupied by the capacitive and inductive structures may be effectively minimized according to the laminated antenna structure of the disclosure, and thus the parasitic coupling effect may be inhibited, the quality factor of the entirety of the antenna mat be reduced, and the impedance bandwidth of the antenna may be effectively increased to improve the radiation characteristics. Moreover, the capacitance value of the laminated antenna structure may be determined by three factors including the thickness of the insulating colloidal layer, the spacing between the overlapped or adjacent portions of the first conductive circuit layer and the second conductive circuit layer, and the dielectric constant and the composition of the material of the insulating colloidal layer. By adjusting the above-mentioned factors, the feed-in capacitance applied to the laminated antenna structure may be varied to achieve the impedance matching, lower the modal resonance frequency of the antenna unit, and increase the operating bandwidth.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A laminated antenna structure, comprising:

a substrate;

a first conductive circuit layer, disposed on or over the substrate;

a second conductive circuit layer, disposed over the first conductive circuit layer;

an insulating colloidal layer, disposed between the first conductive circuit layer and the second conductive circuit layer, and the first conductive circuit layer, the insulating colloidal layer and the second conductive circuit layer form a laminated capacitive structure; and a conductive structure, electrically connected to a signal source on the substrate, and the signal source is electrically connected to at least one of the first conductive circuit layer and the second conductive circuit layer, wherein a material of the insulating colloidal layer comprises a resin, an organic solvent, and catalyzers, and the catalyzers are selected from a group consisting of organometallic particles and ionic compounds, wherein the catalyzers account for 0.1-10 percent by weight of the insulating colloidal layer, and the organometallic particles comprise R-M-R' or R-M-X, wherein R and R' are each independently an alkyl group, aromatic hydrocarbon, cycloalkyl, haloalkane, aheterocyclic ring, or carboxylic acid, and a carbon number of at least one of R and R' is 3 or more; M is one selected from a group consisting of silver, palladium, copper, gold, tin, and iron, or a combination thereof; and X is a halogen compound or an amine;

the ionic compounds comprise $CuCl_2$, $Cu(NO_3)_2$, $CuSO_4$, $Cu(OAc)_2$, AgCl,$AgNO_3$, $Ag_2SO_4$, Ag(OAc), Pd(OAc), $PdCl_2$, $Pd(NO_3)_2$, $PdSO_4$, $Pd(OAc)_2$, $FeCl_2$, $Fe(NO_3)_2$, $FeSO_4$, or $[Fe_3O(OAc)_6(H_2O)_3]OAc$.

2. The laminated antenna structure of claim 1, further comprising an additional insulating colloidal layer formed on the substrate, and the first conductive circuit layer is formed on the additional insulating colloidal layer, wherein a material of the additional insulating colloidal layer is the same as the material of the insulating colloidal layer.

3. The laminated antenna structure of claim 1, wherein a material of the substrate comprises glass, sapphire, silicon, silicon germanium, silicon carbide, gallium nitride, or a polymer material.

4. The laminated antenna structure of claim 1, wherein the resin comprises polyphenylene oxide (PPO), bismaleimide triazine (BT), cyclo olefin copolymer (COC), a liquid crystal polymer (LCP), polyimide, or an epoxy resin.

5. The laminated antenna structure of claim 1, wherein the material of the insulating colloidal layer further comprises an absorbent or a colorant.

6. The laminated antenna structure of claim 5, wherein the colorant comprises carbon black, titanium dioxide, or an organic colorant.

7. The laminated antenna structure of claim 1, wherein the insulating colloidal layer further comprises a fiber structure.

8. The laminated antenna structure of claim 1, wherein the insulating colloidal layer further comprises ceramic particles.

9. The laminated antenna structure of claim 1, wherein the catalyzers account for 0.5-10 percent by weight of the insulating colloidal layer.

10. The laminated antenna structure of claim 1, further comprising a conductive via in the insulating colloidal layer, and a laminated inductive structure is formed by a portion of the first conductive circuit layer, a portion of the second conductive circuit layer and the conductive via electrically connected therebetween.

11. The laminated antenna structure of claim 10, wherein a material of the conductive via comprises copper, nickel, or silver.

12. The laminated antenna structure of claim 1, wherein the first conductive circuit layer further comprises a coplanar inductive structure formed on or over the substrate.

13. The laminated antenna structure of claim 12, wherein a shape of the coplanar inductive structure comprises rectilinear shape, zigzag shape, S-shape, or spiral shape.

14. The laminated antenna structure of claim 1, wherein the second conductive circuit layer further comprises a coplanar inductive structure formed on the insulating colloidal layer.

15. The laminated antenna structure of claim 14, wherein a shape of the coplanar inductive structure comprises rectilinear shape, zigzag shape, S-shape, or spiral shape.

16. The laminated antenna structure of claim 1, wherein a thickness of the insulating colloidal layer is thinner than 1900 μm.

17. A laminated antenna structure, comprising:

a substrate;

a first conductive circuit layer, disposed on or over the substrate;

a second conductive circuit layer, disposed over the first conductive circuit layer;

an insulating colloidal layer, located between the first conductive circuit layer and the second conductive circuit layer;

a conductive via, located in the insulating colloidal layer, wherein the conductive via connects the first conductive circuit layer and the second conductive circuit layer, so as to form a laminated inductive structure; and a conductive structure, electrically connected to a signal source on the substrate, and the signal source is electrically connected to one of the first conductive circuit layer and the second conductive circuit layer, wherein a material of the insulating colloidal layer comprises a resin, an organic solvent, and catalyzers, the catalyzers are selected from a group consisting of organometallic particles and ionic compounds, wherein the catalyzers account for 0.1-10 percent by weight of the insulating colloidal layer, and the organometallic particles comprise R-M-R' or R-M-X, wherein R and R' are each independently an alkyl group, aromatic hydrocarbon, cycloalkyl, haloalkane, a heterocyclic ring, or carboxylic acid, and a carbon number of at least one of R and R' is 3 or more; M is one selected from a group of silver, palladium, copper, gold, tin, and iron, or a combination thereof; and X is a halogen compound or an amine;

the ionic compounds comprise $CuCl_2$, $Cu(NO_3)_2$, $CuSO_4$, $Cu(OAc)_2$, AgCl, $AgNO_3$, $Ag_2SO_4$, Ag(OAc), Pd(OAc), $PdCl_2$, $Pd(NO_3)_2$, $PdSO_4$, $Pd(OAc)_2$, $FeCl_2$, $Fe(NO_3)_2$, $FeSO_4$, or $[Fe_3O(OAc)_6(H_2O)_3]OAc$.

18. The laminated antenna structure of claim 17, further comprising an additional insulating colloidal layer formed on the substrate, and the first conductive circuit layer is formed on the additional insulating colloidal layer, wherein a material of the additional insulating colloidal layer is the same as the material of the insulating colloidal layer.

19. The laminated antenna structure of claim 17, wherein a material of the substrate comprises glass, sapphire, silicon, silicon germanium, silicon carbide, gallium nitride, or a polymer material.

20. The laminated antenna structure of claim 17, wherein the resin comprises polyphenylene oxide (PPO), bismaleimide triazine (BT), cyclo olefin copolymer (COC), a liquid crystal polymer (LCP), polyimide, or an epoxy resin.

21. The laminated antenna structure of claim 17, wherein the material of the insulating colloidal layer further comprises an absorbent or a colorant.

22. The laminated antenna structure of claim 21, wherein the colorant comprises carbon black, titanium dioxide, or an organic colorant.

23. The laminated antenna structure of claim 17, wherein the insulating colloidal layer further comprises a fiber structure.

24. The laminated antenna structure of claim 17, wherein the insulating colloidal layer further comprises ceramic particles.

25. The laminated antenna structure of claim 17, wherein the catalyzers account for 0.5-10 percent by weight of the insulating colloidal layer.

26. The laminated antenna structure of claim 17, wherein a thickness of the insulating colloidal layer is thinner than 1900 μm.

27. The laminated antenna structure of claim 17, further comprising a laminated capacitive structure formed by a portion of the first conductive circuit layer, the insulating colloidal layer, and a portion of the second conductive circuit layer.

28. The laminated antenna structure of claim 17, wherein a material of the conductive via comprises copper, nickel, or silver.

* * * * *